United States Patent [19]

Prazak, III

[11] 4,052,519

[45] Oct. 4, 1977

[54] NON-SETTLING PROCESS FOR COATING A PHOSPHOR SLURRY ON THE INNER SURFACE OF A CATHODE RAY TUBE FACEPLATE

[75] Inventor: Charles J. Prazak, III, Elmhurst, Ill.

[73] Assignee: Zenith Radio Corporation, Glenview, Ill.

[21] Appl. No.: 592,431

[22] Filed: July 2, 1975

[51] Int. Cl.[2] ..... B05D 5/06; B05D 3/12

[52] U.S. Cl. ..... 427/68; 427/72; 427/110; 427/165; 427/168; 427/232; 427/233; 427/240; 427/71

[58] Field of Search ..... 427/71, 72, 240, 168, 427/110, 165, 68, 232, 233

[56] References Cited

U.S. PATENT DOCUMENTS

| | | | |
|---|---|---|---|
| 3,376,153 | 4/1968 | Fiore | 427/72 |
| 3,467,059 | 9/1969 | Korner | 427/240 |
| 3,653,941 | 4/1972 | Bell | 427/72 |
| 3,672,932 | 6/1972 | D'Augustine | 427/72 |
| 3,701,674 | 10/1972 | Kimbrough | 427/72 |

*Primary Examiner*—Michael F. Esposito
*Attorney, Agent, or Firm*—John H. Coult

[57] ABSTRACT

This disclosure depicts a non-settling process for forming on an inner viewing surface of a color cathode ray tube faceplate, a coating of an aqueous slurry composed of an organic binder and a suspension of particulate phosphor material of distributed particle size, which coating exhibits an extraordinarily suppressed radial streaking, a high degree of coating weight uniformity, and a predictable particle size distribution. The process comprises supporting the faceplate such that the central axis of the faceplate has a substantial horizontal component and slowly rotating the faceplate about the central axis thereof while dispensing a stream of phosphor slurry having a predetermined phosphor particle size distribution onto the central region of the faceplate inner surface, preferably substantially at the axis of rotation, such that due to gravitational forces and the slow rotation of the faceplate through the descending slurry stream, the slurry is suffused to the perimeter of the faceplate inner surface without any significant settling out of the phosphor particles onto the faceplate. The coating is then levigated by rotating the coated faceplate at a moderate angular velocity for a brief time interval, the joint effect of which moderate angular velocity and brief time interval being to level the coating down to a predetermined thickness while suppressing the formation of radial streaks in the coating radially outward of irregularities in or on the faceplate inner surface.

20 Claims, 3 Drawing Figures

NON-SETTLING PROCESS FOR COATING A PHOSPHOR SLURRY ON THE INNER SURFACE OF A CATHODE RAY TUBE FACEPLATE

BACKGROUND OF THE INVENTION

Color cathode ray tube faceplates typically comprise a dished viewing portion having a concave inner surface upon which a phosphor screen is deposited. The screen comprises a mosaic of intercalated patterns of red-emissive, blue-emissive and green-emissive phosphor elements. The patterns of elements are deposited in succession, each by a series of operations which includes the application of a coating of an aqueous phosphor slurry to the faceplate inner surface. This invention concerns an improved process for applying such phosphor slurry coatings to the inner viewing surface of a color cathode ray tube faceplate. The phosphor slurries involved typically include a photosensitized organic binder and a suspended particulate phosphor material having a predetermined particle size distribution. The organic binder, typically PVA (polyvinyl alcohol), its sensitizer, and the phosphor material are commonly collectively termed the slurry "solids."

All known methods for disposing phosphor slurry coatings on color cathode ray tube faceplates involve an operation wherein a quantity of phosphor slurry is suffused or spread across the faceplate surface to be coated. This suffusion operation generally involves the application of a puddle of slurry to the surface to be coated, followed by one or more operations which cause the puddle of slurry to be spread across all areas of the surface. The excess slurry is then removed. Finally, a "levigation" operation is employed by which the suffused coating is leveled and thinned down to a predetermined thickness; typically this is accomplished by very rapidly spinning the faceplate, or in the disclosure of U.S. Pat. No. 3,700,444, by inverting the faceplate.

A number of important requirements are imposed upon the process by which phosphor slurry coatings are applied to a color cathode ray tube faceplate. Any process developed for applying phosphor slurry coatings to color CRT faceplates desirably should meet all these requirements, however, no known process has achieved all of these requirements.

Perhaps the most important requirement is that the coatings formed be uniform in weight throughout the viewing area of a given faceplate, and uniform from faceplate-to-faceplate during extended periods of factory production. It is also of utmost importance that the coatings be relatively thin, and yet have a sufficiently high phosphor particle density and phosphor coating weight that the cathode ray tube images ultimately produced will have maximum brightness. As used herein, the term "phosphor coating weight" means the weight per unit area of coated phosphor material, i.e., absent the binder and water. The term "phosphor particle density" or "phosphor density" refers to the weight of phosphor material per unit of volume, i.e., to how tightly the phosphor particles are packed. Phosphor density and phosphor coating weight are both important determinants of image brightness.

Any severe non-uniformities in the screen, such as result from radical variations in coating thickness, radial "streaks"tangential "sags", etc. which would be visible in the reproduced images must, of course, be suppressed to a tolerable level.

It is desirable also, in the interest of achieving maximum brightness in the reproduced images, that the phosphor particle size distribution in the resultant phosphor slurry coatings be in accordance with a specified predetermined particle size distribution. This holds not only over the viewing area of a given faceplate, but from faceplate-to-faceplate in factory production.

Further, for economic reasons it is desirable that the application of phosphor slurry coatings to color cathode ray tube faceplates be achieved in as brief an interval as possible and with a minimum number of work stations, and that the least possible expense be incurred in capital equipment and unit labor cost. It is also desirable that in the application of successive phosphor slurry coatings, later-deposited coatings do not contaminate earlier-deposited coatings.

A number of prior art methods for applying phosphor slurry coatings have been developed, however, none has been completely successful in meeting all the above-stated requirements. The commercially most common methods involve applying a puddle of slurry onto the concave inner surface of a faceplate while the faceplate is in a face-down position. The puddle is then suffused across the surface to be coated by tilting and rotating the panel to cause the puddle to move across all areas of the entire surface to be coated, or alternatively, by spinning the panel to cause the puddle to spread by centrifugal force across the faceplate inner surface. For example, see RCA Review, Vol. 16, pp. 122–139 (March, 1955) and U.S. Pat. Nos. 2,902,973; 3,319,759; 3,376,153; 3,364,054; 3,467,059; and 3,700,444.

Conventional faceplates have a rearwardly extending flange which contains the puddle. This invention is applicable to such conventional faceplates and color cathode ray tube faceplates in general, but is perhaps especially suited for use with a color cathode ray tube faceplate having a dished viewing portion but no flange, as will be described below.

These "puddling" methods are predicated on the principle that in order to achieve the high phosphor coating weights in the resultant phosphor slurry coatings, now deemed so necessary for high brightness image reproduction, a protracted time interval must be allotted for the phosphor particles, particularly the heaviest (and largest) particles, to settle out onto the surface to be coated. It is noteworthy that the alleged teaching of U.S. Pat. No. 3,653,941, self-touted to be an improvement on the methods of the prior art, causes the slurry to spiral inwardly and outwardly over the surface to be coated such that "additional time is allowed for particles in the slurry to settle upon the surface." In both the tilt-and-rotate method and the spin method of slurry coating, sufficient time is allotted for this sedimentation or settling out process to occur. The allotted sedimentation interval may, for example, be 60–80 seconds. The necessity for the provision of an adequate settling-out interval, however, results in an undesirably long duration coating operation.

Further, by the fact of the settling out of the phosphor particles from the phosphor slurry, the excess slurry which is dumped or spun from the panel cannot be reused without its first being reconstituted. This is because of the settling out of the phosphor particles from the slurry. For example, in a typical prior art process the dispensed slurry might have about 30% phosphor content (by weight), as dispensed. However, due to the settling out of the phosphor particles, the excess slurry will contain phosphor material in a substantially lower percentage than 30%. In order to bring the phosphor content back to predetermined value, and to maintain a predetermined phosphor-to-binder ratio, a "make-up" or "replenish" slurry, must be added to the collected slurry. Such a make-up slurry might have, e.g., a phosphor content of 45%, and will also have an increased phosphor-to-binder ratio. The actual phosphor contents and the phosphor-to-binder ratio are quite variable and must be monitored and controlled, a technically difficult task necessitating exacting measurements of phosphor content in the slurry and of slurry viscosity. It should be noted that whereas it is important to know and control the phosphor-to-binder ratio at all times during production, because of the difficulty and inconvenience of doing so, it is not industry practice to measure the phosphor-to-binder ratio in a slurry directly. Rather, phosphor content and slurry viscosity are periodically measured. Since the viscosity of a slurry is largely a function of temperature and relative content of water and binder in the slurry, if the slurry viscosity and phosphor content are maintained, it can be assumed that the phosphor-to-binder ratio is constant.

Due to the extreme difficulty in maintaining uniformity in the particle size distribution from faceplate-to-faceplate in factory production, control of particle size distribution in the dispensed phosphor slurry is generally neglected. As a result, the particle size distribution in such coatings will inevitably vary with time during a production run, resulting in the production of tubes having varying phosphor coating properties and hence varying brightness capabilities.

Further, any shifting in the particle size distribution toward lighter average particle sizes, when such a shift occurs during production, may result in aggravated color contamination in the reproduced images. This comes about because there are not one, but three, phosphor slurry coatings which are applied in succession to the inner surface of a faceplate. When the second layer is deposited upon the first layer, the finer particles in the second phosphor slurry coating tend to settle into crevices in the first layer and remain there after processing of the faceplate is completed. Similarly, upon application of the third phosphor slurry coating, the finer particles in the third phosphor slurry tend to settle into and permanently remain in the crevices in the first and second slurry coatings. Upon excitation by electron bombardment in the end-product tube, the contaminating phosphor particles emit light which contaminates or desaturates the true color light output.

The afore-described prior art methods, in general, involve a coating leveling or "levigation" process in which the faceplate is spun at high speeds to thin down and level the coatings of phosphor slurry which have been suffused across the faceplate inner surface. By the nature of the puddling-type processes, a relatively thick layer of phosphor slurry is deposited upon the faceplate surface. In order to thin down this thick layer to an acceptable coating thickness, the panel must be spun at an undesirably high speed (e.g. 250–300 RPM) for undesirably long interval, e.g., 15–20 seconds. It has been found that if a faceplate is spun at an excessively high speed during the leveling operation, or is spun at a more moderate speed for an excessively long interval, radial streaks or spokes are formed in the coatings. The radial streaks in the coating are caused by irregularities in the glass faceplate surface, or phosphor or black grille patterns on the faceplate surface, which interrupt the phosphor slurry being impelled radially outwardly by the centrifugal forces of rotation.

In the afore-described process in which the faceplate is spun to suffuse the dispensed slurry across the faceplate inner surface, the excess slurry is typically not removed by inverting the panel, as is common in tilt-type processes. Rather, the excess slurry is removed by spinning the faceplate at very high speeds to drive the excess slurry to the perimeter of the viewing surface and up and over the inner walls of the faceplate flange whereupon it is thrown from the faceplate by centrifugal force. Such high spin speeds have been found to cause radial streaking in the coatings formed.

Attempts have been made to develop commercially viable slurry coating processes which would not require the sedimentation principle and thus which would not suffer from the aforediscussed shortcomings of sedimentation processes — e.g., see the FIG. 9 embodiment of U.S. Pat. No. 3,700,444. No non-sedimentation slurry process is known, however, prior to this invention, which results in the deposition of slurry coatings having commercially acceptable phosphor coating weights and thus commercially acceptable image brightness in the reproduced CRT images. It has heretofore been thought to be impractical, if not impossible, to deposit slurry coating of commercially adequate phosphor coating weight by any non-sedimentation process.

In the tilt-type process excess slurry is typically dumped from a corner of the faceplate. This introduces yet another shortcoming of the prior art tilt-type puddling process. By the fact of dumping from a corner of the faceplate, the resultant phosphor coatings are found to be heavier in the region of the faceplate where dumping is effected than in other regions of the faceplate. By way of example, variations in coating weight from corner to corner of a faceplate of $\pm 10\%$ are common in the practice of the tilt-type prior art process. The result is an uneven brightness in the images produced by the end-product tube.

It is known in the commercial manufacture of black grilles for color cathode ray tubes of the black matrix type to apply a uniform layer of a graphite material to the inner surface of a color cathode ray tube faceplate by flowing a graphite solution onto the faceplate while it is being rotated in a substantially vertical attitude. Such a process is disclosed in U.S. Pat. No. 3,652,323. A similar process is used earlier in the grill-making operation to apply a photosensitized PVA coating under the graphite layer. The graphite and PVA coating processes have little or no relevance, however, to the invention described and claimed herein.

OBJECTS OF THE INVENTION

It is a general object of this invention to provide an improved process for forming a phosphor slurry coating on an inner viewing surface of a color cathode ray tube faceplate.

It is another object of this invention to provide such a process which results in the formation of phosphor slurry coating which have an extraordinarily high degree of coating weight uniformity across a given faceplate and from faceplate-to-faceplate in factory production.

It is an object of this invention to provide such a process which yields coatings which are relatively thin and yet which have a relatively high phosphor coating weight.

It is still another object of this invention to provide a process for forming such coatings which requires very little, if any, reconstitution of salvaged excess slurry, and yet which results in the formation of coatings having improved coating weight uniformity and improved controllability of phosphor particle size distribution.

It is yet another object of this invention to provide a process for applying phosphor slurry coatings to color cathode ray tube faceplates which is relatively rapid and permits the use of a fewer number of coating stations than is required by prior art processes.

It is a further object of this invention to provide such a process which results in reduced color cross contamination in the deposited phosphor slurry coatings.

It is still another object to provide such a process which results in suppressed radial streaking and other spin-related non-uniformities in the resultant phosphor slurry coatings.

DESCRIPTION OF THE PREFERRED EMBODIMENT

Figure 1:
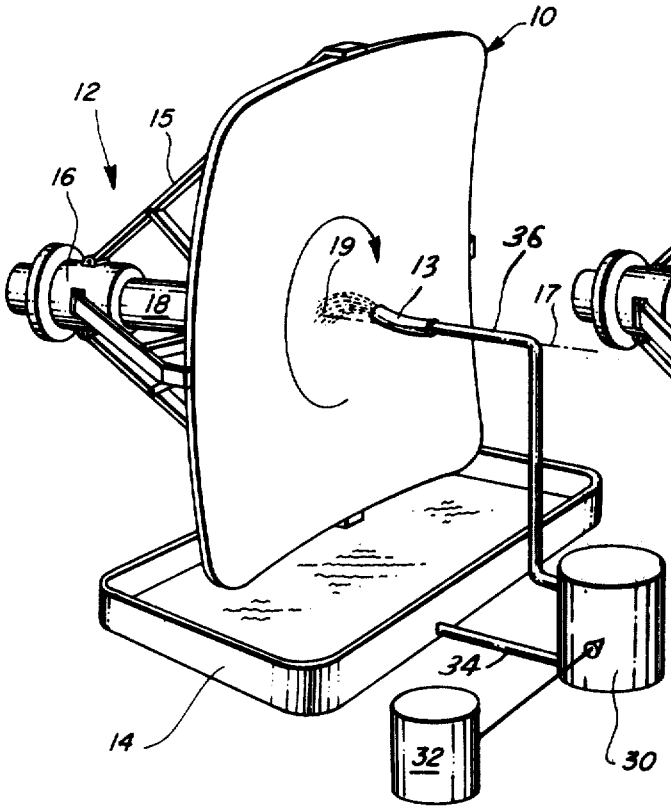
FIGS. 1 and 2 are perspective and side views of apparatus which may be employed to apply phosphor slurry coatings according to the process of this invention on faceplates of a flangeless character.

This invention concerns a process for forming one or more highly uniform coatings of phosphor slurry on the inner viewing surface of a color cathode ray tube faceplate. In the manufacture of color cathode ray tubes as known today, it is necessary to form on the inner surface of the transparent viewing window, commonly termed the faceplate, a phosphor screen in the form of a mosaic of intercalated red-emissive, blue-emissive and green-emissive phosphor elements. Conventionally, this mosaic of phosphor elements is made by depositing a first pattern of phosphor elements (typically green-emissive), followed by deposition of a second pattern of phosphor elements (typically blue-emissive) in the open areas between the green-emissive phosphor elements, and finally by depositing in the remaining space a third pattern of phosphor elements (typically red-emissive).

Each of these afore-described patterns of phosphor elements are made by first forming a coating of phosphor slurry over the faceplate inner surface. This slurry is typically an aqueous composition including an organic binder such as PVA (polyvinyl alcohol) which has been photosensitized, as for example with ammonium dichromate, in which is suspended a particulate phosphor material of distributed particle size. This coating is exposed through a stencil and developed, leaving on the surface a pattern of phosphor elements. These deposition, exposure and development operations are repeated twice more to form the mosaic of three intercalated patterns of phosphor elements emissive of red, blue and green light.

Today's color cathode ray tubes are almost universally of the negative guardband, black surround type, as taught by U.S. Pat. No. 3,146,368, which includes a "black grille". A black grille is a layer of light-absorptive material having a pattern of openings, one at every location of a phosphor element, into which openings the phosphor elements are deposited. The black grille provides enhanced contrast in the reproduced CRT images by absorbing ambient room light falling on the screen. In tubes of the type having a black grille, the grille is conventionally deposited on the inner surface of the faceplate before the patterns of phosphor elements are deposited.

This invention concerns an improved process for forming the coatings of phosphor slurry on the inner surface of a color cathode ray tube faceplate. As noted above, these coatings may be placed either on the bare inner surface of a faceplate, or, in tubes of the type having a black grille, over the black grrille.

In general terms, the method of this invention involves supporting the faceplate to be coated such that the plane of the faceplate has a substantial vertical component, i.e., the faceplate central axis has a substantial horizontal component. The faceplate is slowly rotated about its central axis while a stream of phosphor slurry is dispensed onto the faceplate inner surface, preferably substantially at the axis of rotation. Because of the substantially vertical attitude of the faceplate, the slurry flows by gravity down across the faceplate. Excess slurry draining from the faceplate is collected for re-use. The slow rotation of the faceplate through the descending slurry stream causes the slurry to suffused across all areas of the faceplate inner surface to the perimeter thereof without any significant settling out of the phosphor particles onto the faceplate. The fact that the particles are by intent not permitted to settle out of the slurry is extremely significant and forms an important aspect of this invention, as will be described in more detail hereinafter.

The coating is then levigated preferably after providing a short delay to permit "sags" (tangential areas of irregular coating thickness) in the coating to even out. Levigation is achieved by rotating the coated faceplate at a moderate angular velocity for a brief time interval, the joint effect of which moderate angular velocity and brief time interval being to level the coating down to a predetermined thickness while suppressing the formation of radial streaks in the coating radially outward of irregularities in or on the faceplate inner surface.

In a preferred form of the invention, the excess slurry drained from the faceplate in the dispensing operation is collected and fed directly back for redispensation to the same or another faceplate without the addition of a significantly different make-up slurry. The ability to feed the collected excess slurry directly back for redispensation without the need to add any significantly different make-up slurry constitutes an important aspect of this invention, as will be described hereinafter.

The various operations and associated structures and compositions involved in the process of this invention will now be described in much more detail. The first step of the process, described above in general terms, is the supporting of the faceplate such that the plane of the faceplate has a substantially vertical component, i.e., such that the faceplate central axis has a substantial horizontal component. This operation is shown schematically in FIG. 1. As noted above, whereas this invention has general applicability to the coating of phosphor slurry on color cathode ray tube faceplates of various types, it is perhaps especially useful for coating faceplates which do not have a rearwardly extending flange. Such a flangeless faceplate is shown at 10 in FIG. 1. FIG. 1 also shows support means 12 for supporting the faceplate 10, a nozzle 13 from which slurry is dispensed onto the faceplate 10, and a collector 14 for collecting excess slurry which drains from, or which is otherwise discharged from, the faceplate 10.

Figure 2:
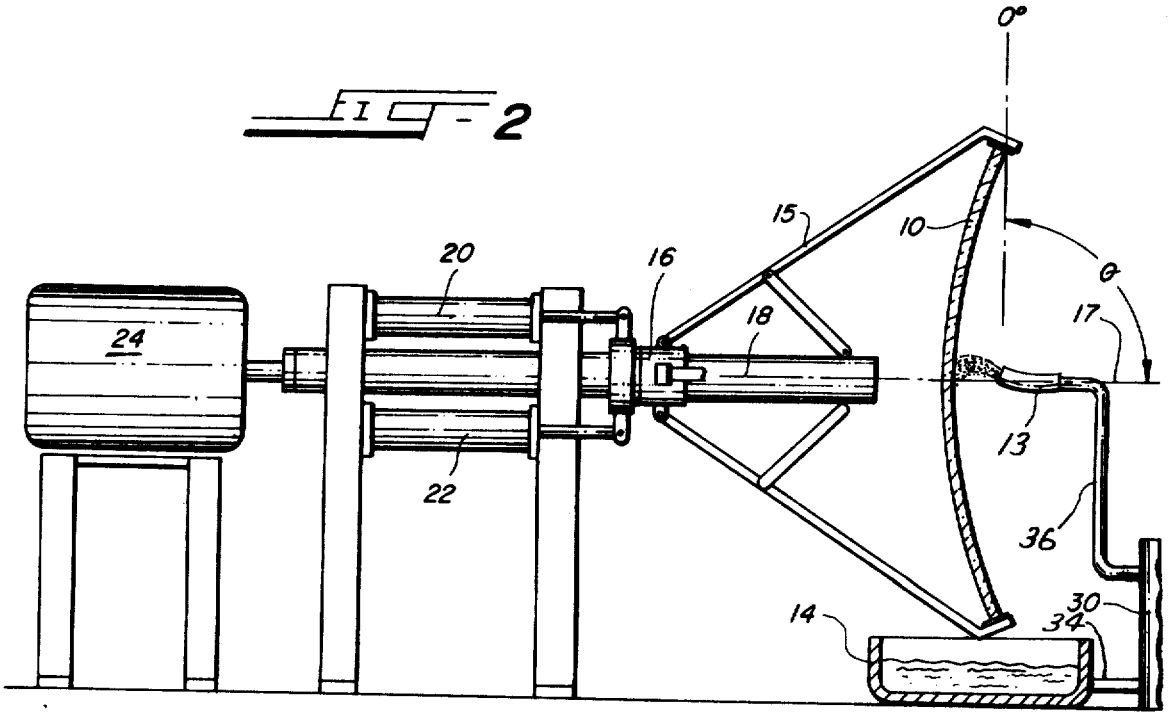

The support means 12 is illustrated as taking the form of an articulated linkage comprising four arms 15 which grasp the edges of the faceplate 10 and hold it securely for rotation, preferably about its central axis 17. (Alternatively, a vacuum chuck of conventional construction may be employed to support the faceplate). A side view of the FIG. 1 apparatus is shown in FIG. 2. The support means includes a slideable collar 16 which is driven along a shaft 18 by pneumatic pistons 20, 22 to cause the arms 15 to expand away from or contract upon a faceplate 10 to be supported. A drive motor 24 drives the shaft 18 under command of a control system (not shown). As will be described in more detail below, the drive motor is driven at a slow speed during dispensation of the slurry and at a moderate speed when it is desired subsequently to levigate the slurry coating.

The slurry is applied to the faceplate 10 through nozzle 13 at a predetermined flow rate. The nozzle may be a simple open-ended tube having an outside diameter of about ⅜ inch, e.g, which is preferably angled slightly upwardly. The stream 19 of slurry issuing from the nozzle 13 is preferably directed so as to hit the faceplate at approximately the axis of rotation of the faceplate (also the central axis 17 of the faceplate). The impinging stream should be sufficiently limp as to not cause the formation of bubbles in the slurry. The nozzle should be purged prior to each dispensation operation, or run continuously, to avoid the dispensation of slurry in which phosphor has settled out in the nozzle. This arrangement of nozzle 13 and slurry stream 19 has been found to produce the most uniform phosphor slurry coatings.

The faceplate is supported such that the central axis 17 of the faceplate (taken from the concave side of the faceplate as shown), makes an angle $\theta$ of between about 45° and 140° from the vertical, the zero position being that vertical position which the faceplate axis assumes when the faceplate is horizontal and face up. The faceplate is preferably supported at substantially a vertical attitude, that is, such that the central axis 17 of the faceplate is substantially horizontal. With the faceplate in this attitude, slurry dispensed on the inner surface of the faceplate will drain by gravity across the faceplate inner surface and into the collector 14.

The preferred attitude of the faceplate is one in which the central axis 17 of the faceplate 10 is slightly greater than 90°, for example 100°, i.e., one in which the faceplate is substantially vertical but with a slight downward tilt. It is possible to tilt the faceplate axis downwardly as much as 45°-50° to the horizontal, that is, e.g., to a $\theta$ value of 135°-140°, but for $\theta$ values at the upper end of this range and beyond the gravitational effects which are employed to suffuse the slurry across the faceplate inner surface become undesirably low in value.

It is also possible to carry out the method of this invention with the faceplate tilted upwardly as much as 45° from the horizontal, that is, to a $\theta$ value of 45°; however, with the faceplate in this extreme position and beyond it has been found that the slurry will be thrown over the faceplate support apparatus, an obviously undesirable event.

With the faceplate thus supported, it is caused to be rotated slowly, in fact so slowly that the contributive forces causing the slurry to be suffused outwardly across the panel inner surface are largely gravitational; centrifugal force contributions are not substantial by comparison. The panel is rotated at an angular velocity of from 5 to 30 revolutions per minute (RPM), preferably in the range of 14–24 RPM. Rotational speeds somewhat higher or lower than this range may be employed but are not found to be preferred.

The slurry dispense interval may last in the range of approximately 10–20 seconds, or perhaps somewhat longer, during which time, as a result of the slow angular rotation of the faceplate through the falling stream 19 of phosphor slurry, the phosphor slurry is suffused to the perimeter of the faceplate. During the dispensation operation, the faceplate is preferably preheated to aid in drying of the slurry as it is being coated.

It is an important aspect of this invention that, due primarily to the substantially vertical attitude of the faceplate during the slurry dispense interval, no significant settling out of the phosphor particles can occur. As noted above, the prior art puddling processes are predicated upon providing a substantially horizontal (face-down) attitude of the faceplate and sufficient residence time of the slurry on the faceplate to cause very significant settling out of the phosphor particles to occur. This is an essential aspect of the prior art processes in order to achieve the necessary high phosphor coating weight.

In a preferred form of this invention the dispensation operation is followed by a short delay which may, for example, be in the range of a few seconds to 15 or 20 seconds. The delay is desirable to allow time for any uneveness in the dispensed coating, principally tangential "sags", to even themselves out. It has been found that if the coating is levigated immediately after suffusion of the coating (zero delay), exaggerated sag marks are apt to be formed in the end-product slurry coatings. The effect has been found to vary with differing substrate and phosphor slurry characteristics, but is most noticeable in the green phosphor slurry coating operation (the first coating normally put down).

Unlike the conventional polyvinyl alcohol flow coating process, during the delay between suffusion and levigation the faceplate is rotated, preferably at the same slow speed used during the suffusion operation.

In order to provide a thin, level phosphor slurry coating of predetermined thickness, the faceplate is rotated at a higher angular velocity than used during the dispensation operation, for example, 30–200 revolutions per minute or slightly more. Although it is possible to perform the method of this invention at rotational speeds during levigation of 200 revolutions per minute or perhaps even higher, it is desirable to operate in the middle-upper end of that range, for example, at a moderate velocity of 100–200 RPM. The levigation interval is preferably very brief, e.g., 3–10 seconds.

An understanding of the reason for selection of these operating parameters requires an understanding of such process considerations as radical streaking, coating porosity, and overall time interval required for slurry coating. Low rotational velocities suppress radial streaking, but too low velocities necessitate undesirably long levigation intervals and result in the formation of pores in the coating, reducing picture brightness. Long duration levigation intervals in turn imply undesirably long overall coating intervals.

In accordance with as aspect of this invention, during the levigation operation the coated faceplate is rotated at a moderate velocity for a very brief interval. The use of a moderate velocity (lower than used in prior art levigation processes, but higher than used during the slurry dispensation operation) permits the use of a very brief levigation interval, yet the joint effect of which moderate angular velocity and very brief levigation interval is to suppress the formation of radial streaks on the faceplate, a phenomenon which depends on the duration, as well as the angular velocity, of levigation. The very brief levigation interval results in a greatly shortened overall coating interval, by comparison with prior art methods.

It is not uncommon in the prior art puddling-type processes to find levigation speeds in the order of 250–300 revolutions per minute for durations of 10–20 seconds or lower speeds for much longer time such as 30–90 seconds. As explained above, the higher the rate of rotation of the faceplate during levigation or the longer the time or rotation, the more severe is apt to be the radial streaks produced in the phosphor slurry coatings. A levigation operation in accordance with the present operation may involve a faceplate rotation at 100–200 RPM for only 3–10 seconds, a time-velocity product which is much less than that employed to levigate slurry coatings in the prior art puddling-type processes.

In accordance with the method of this invention, because the phosphor slurry is suffused across the faceplate inner surface and levigated with the faceplate oriented substantially vertically so that no significant settling out of the phosphor particles can occur, the particle size distribution and phosphor content in the collected slurry is substantially the same as in the coated slurry and in the dispensed slurry. Thus the collected excess slurry may be fed, after filtering, directly back to the dispense system for dispensation on the same or a subsequently processed faceplate. The FIGS. 1–2 apparatus includes for this purpose a pump 30 driven by a motor 32. As shown, the pump 30 receives unused slurry drained from the collector 14 through a drain tube 34, impelling it through a feed pipe 28 to the nozzle 13.

It may be necessary in the practice of this invention to add make-up slurry with a few percent greater phosphor content to account for settling out of phosphor particles in the collector and to add water to compensate for evaporation from the slurry. The differences between the make-up slurry which must be added and the dispensed slurry are, in any event, insignificant by comparison with prior art methods and do not require the complex slurry monitoring and adjustment equipment necessitated by prior art processes. This invention is believed to make possible for the first time automatic slurry adjustment by the simple addition of water to compensate for evaporation.

As explained at some length above, in prior art puddling-type slurry coating processes, because sufficient time is intentionally provided for the phosphor particles, particularly the heavier particles, to settle out onto the faceplate inner surface, the collected phosphor slurry has a particle size distribution and phosphor content which is substantially altered from that of the dispensed slurry. Thus the collected excess slurry must be reconstituted by the addition of a make-up slurry (which has an excess of phosphor) before it can be fed back to the dispensing instrumentality. As suggested, this requires complex and exacting systems and procedures for monitoring the phosphor content and viscosity of the collected slurry, of the dispensed slurry and of the make-up slurry. In spite of the provision of complex monitoring systems, and procedures in prior art practices during factory production the phosphor content and particle size distribution inevitably varies, resulting in variations from unit-to-unit in the coating weight of the phosphor particles deposited and in the resultant brightness of the end-product color cathode ray tube images. Also, as noted above, when the particle size distribution varies toward smaller average particle size, the problem of cross-contamination of earlier-deposited phosphor coatings is aggravated and picture brightness and color purity in the end-product tube decreases.

As made clear above, the sedimentation type processes of establishing an adequately high phosphor coating weight in the end-product slurry coatings is deliberately avoided in the method of this invention. Rather, the necessary phosphor coating weight values are achieved by controlling the levigation time and velocity and by using a super dense phosphor slurry. By way of example, phosphor slurries used in prior art puddling-type processes may typically have a phosphor content of 30–36%, i.e., the content of the phosphor materials in the aqueous slurry suspension constitutes 30–36% by weight. The viscosity of slurries used in prior art pudding-type processes may, e.g., be 30 to 40 CPS (centipoise). By contrast, in the practice of this invention it is preferred (although not absolutely necessary) to use phosphor slurries having a higher phosphor content e.g., up to 45% or more with higher than typical viscosities. By way of example, the following general phosphor slurry and slurry coating compositions are preferably employed in the practice of this invention, covering all three phosphor slurries (red, blue and green):

| | | | | |
|---|---|---|---|---|
| Phosphor content (by weight) | 36% | to | 45% | |
| Coating weight (dry) | 3 | to | 5 | mg/cm² |
| Average particle size | 7 | to | 14 | microns |
| Phosphor-to-PVA ratio | 10:1 | to | 30:1 | |
| Viscosity | 40 | to | 60 | cps (centipoise) |

The phosphor slurry coating process of this invention has been successfully tested and data taken. A set of test data is reproduced below.

TEST DATA

| | Green Phosphor Slurry | Red Phosphor Slurry | Blue Phosphor Slurry |
|---|---|---|---|
| Number of faceplates run | 10 | 10 | 10 |
| Faceplate incoming temperature at dispense (in ° F) | 114 | 110 | 110 |
| Average dry slurry coating weight (in mg/cm²) | | | |
| center of faceplate | 3.29 | 4.13 | 4.01 |
| one corner | 3.55 | 4.47 | 4.30 |
| diagonally opposite corner | 3.49 | 4.35 | 4.25 |
| Phosphor particle size distribution (in microns) | 11 ± 1 | 8 ± .75 | 11 ± 1 |
| Dispensed slurry | | | |
| viscosity at 23° C (in CPS) | 30.5 | 38 | 34 |
| phosphor content (in % by weight) | 41.1 | 37.5 | 41.0 |
| PVA Content (in % by weight) | 2.0 | 2.8 | 2.75 |
| ammonium dichromate (in grams/pound) | .41 | .53 | .39 |
| phosphor-to-PVA ratio | 19.5:1 | 13.1 | 14.5:1 |
| Collected slurry | | | |
| viscosity at 23° C (in CPS) | 30.2 | 36.2 | 33.5 |
| phospher content (in % by weight) | 40.1 | 37.7 | 42.9 |
| PVA content (in % by weight | 2.2 | 3.0 | 2.8 |
| ammonium dichromate (in grams per pound) | .44 | .54 | .40 |

-continued process parameters and slurry specifications were established.

| GREEN PHOSPHOR SLURRY | |
|---|---|
| Slurry Specification | Process Specification |
| Phosphor content = 38 ± 2%<br>Viscosity = 42 ± 2 cps. | Dispense speed = 18 - 24 RPM<br>Dispense time interval = 12 seconds<br>Delay before levigation = 13 ± 2 seconds<br>Speed during delay - same as dispense speed<br>Levigation speed – 115 ± RPM<br>Levigation time interval –6 ± 2 seconds<br>Incoming faceplate temperature at dispense = 112 ± 2° F<br>Outgoing faceplate temperature = 106 ± 2° F<br>Slurry coating weight (dry) = 3.8 ± .15 mg/cm² |
| **BLUE PHOSPHOR SLURRY** | |
| Slurry Specification | Process Specification |
| Phosphor content = 38 ± 2%<br>Viscosity = 47 ± 3 cps | Dispense speed = 24 ± 2 RPM<br>Dispense time interval = 18 seconds<br>Delay before levigation = 6 ± 2 seconds<br>Speed during delay - same as dispense speed<br>Levigation speed = 150 ± 5 rpm<br>Levigation time interval = 3 ± 1 second<br>Incoming faceplate temperature at dispense = 115 ± 2° F<br>Outgoing temperature = 106 ± 2° F<br>Slurry coating weight (dry) = 4.2 ± .15 mg/cm² |
| **RED PHOSPHOR SLURRY** | |
| Slurry Specification | Process Specification |
| Phosphor content = 38 ± 2%<br>Viscosity = 48 ± 3 cps | Dispense speed = 24 ± 2 RPM<br>Dispense time interval = 18 seconds<br>Delay before levigation = 6 ± 2 seconds<br>Speed during delay = same as dispense speed<br>Levigation speed = 200 ± 5 RPM's<br>Levigation time interval = 3 ± 1 seconds<br>Incoming faceplate temperature at dispense = 115 ± 2° F<br>Outgoing temperature = 108 ± 2° F<br>Slurry coating weight (dry) = 4.5 ± .15 mg/cm² |

TEST DATA

| | Green Phosphor Slurry | Red Phosphor Slurry | Blue Phosphor Slurry |
|---|---|---|---|
| phosphor-to-PVA ratio | 17.2:1 | 12.5:1 | 14.3:1 |
| Miscellaneous general specifications<br>slurry flow rate - 1-2 liters per minute<br>variation from faceplate to faceplate in dry slurry coating weight (at center of faceplate) - less than .5%. | | | |

It can be seen from the above test data that no significant settling out of phosphor particles takes place during the slurry coating process of this invention. The phosphor content in the collected slurry is slightly less than in the dispensed slurry for the green phosphor slurry coating process, but slightly greater for the red and blue phosphor coating processes. (The variations are within the normal and expected measurement errors).

Yet, in spite of the non-utilization of any significant sedimentation errors, coating weights are adequately high, due in part to the use of high viscosity, phosphor dense slurries.

As a result of the above-reported tests, and other tests and considerations, the following production screen Many of the important aspects and advantages of the invention have been described above. Another advantage which accrues from the utilization of the present method as compared with prior art puddling-type slurry coating methods, is that the coating process is much faster than the prior art methods. The implication of this is, in a factory context, that fewer coating stations and less capital equipment are required. For example, a conventional puddling-type coating operation may take 90–100 seconds and four work stations (dispense, precoat settling time), precoat, dump-and-spin-off. A coating operation employing the present method may require 30–50 seconds or less and only two work stations (dispense and drain-and-spin-off). Because the number of work stations required to form a slurry coating is reduced by this invention, more time (compared with prior art processes) is available to accomplish other operations such as drying, edge cleaning, etc. Alternatively, additional coating stations may be provided in a given area of factory floor space to increase the through-put of coated faceplates. The more rapid processing achieved by the application of this invention, the need for less capital equipment, and the lower attendant labor cost all contribute to a lower end-product tube cost.

By the practice of the method of this invention, the phosphor slurry coatings which are formed have a degree of coating weight uniformity across the faceplate which is believed to be higher than those achievable with the prior art puddling-type coating processes. For example, by prior art slurry coating processes, variations of about ± 10% across a given faceplate are typically encountered in production. By the practice of this invention, variations of only ± 1-5% have been found. It is true also that coating weight uniformity from faceplate to faceplate during factory production is also greater than typically achieved with prior art processes. Further, the coatings formed are thin and yet have an adequately high phosphor density and phosphor coating weight, a combination which is desirable for maximum brightness in the end-product cathode ray tube images.

Figure 3:
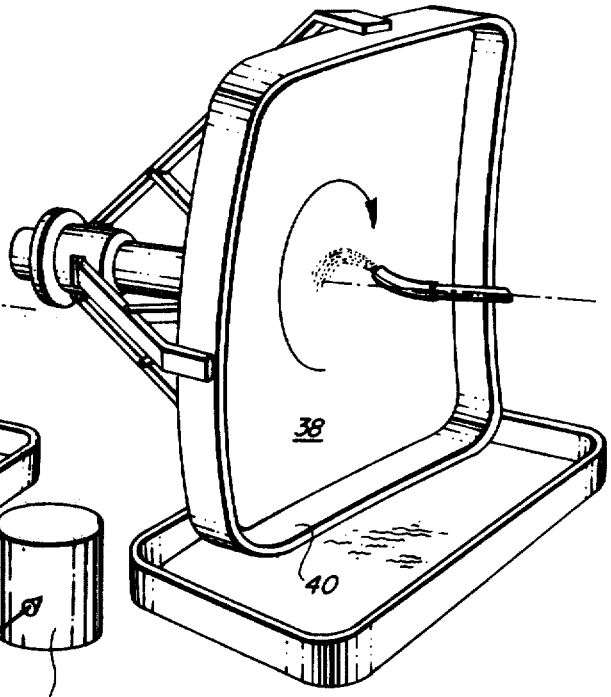
FIG. 3 is a view similar to FIG. 1 showing apparatus which may be employed to apply phosphor slurry coatings according to the process of this invention on faceplates of the conventional type having a rearward flange.

The invention is not limited to the particular details of construction of the embodiments depicted and other modifications and applications are contemplated. Certain changes may be made in the above-described process without departing from the true spirit and scope of the invention herein involved. For example, whereas in FIG. 1 there is shown the application of the method of this invention to a flangeless faceplate, the invention is applicable also to coating phosphor slurry onto faceplates of the conventional flanged type, such as is shown in FIG. 3. FIG. 3 is similar to FIG. 1, except that the faceplate 38 is shown as having a rearwardly extending flange 40. A faceplate of the flanged type would be tilted downwardly ($\theta$ values significantly greater than 90°) to permit drainage of the slurry from the faceplate. Still other changes may be made in the above-described process without departing from the true spirit and scope of the invention herein involved and it is intended that the subject matter in the above depiction shall be interpreted as illustrative and not in a limiting sense.

What is claimed is:

1. A non-settling process for forming on an inner viewing surface of a color cathode ray tube faceplate a coating of an aqueous slurry composed of a photosensitized organic binder and a suspension of phosphor particles, which coating exhibits a high degree of coating weight uniformity, a relatively high phosphor coating weight, and suppressed radial streaking, said process comprising:

supporting the faceplate such that the central axis of the faceplate has a substantial horizontal component;

slowly rotating the faceplate about the central axis thereof while dispensing a stream of phosphor slurry onto the central region of the faceplate inner surface such that, due to gravitational forces and the slow rotation of the faceplate through the descending slurry stream, the slurry is suffused to the perimeter of the faceplate inner surface without any significant settling out of phosphor particles onto the faceplate; and levigating the coating by rotating the coated faceplate at a moderate angular velocity for a brief time interval, the joint effect of which moderate velocity and interval being to level and thin down the coating to a predetermined thickness while suppressing the formation of radial streaks in the coating radially outwardly of irregularities in or on the faceplate inner surface.

2. The method defined by claim 1 wherein the angular velocity of said faceplate during the slurry dispensation and suffusion operation is between about 5 and 30 revolutions per minute and the dispense interval is between about 10-20 seconds.

3. The method defined by claim 1 wherein during said levigation operation the faceplate is spun at an angular velocity of 100-200 revolutions per minute for a time interval which is between about 3-10 seconds.

4. The process defined by claim 1 wherein the angle of the faceplate axis to the vertical on the concave side of the faceplate is slightly greater than 90°.

5. The process defined by claim 4 wherein said angle is preferably about 100°.

6. The process defined by claim 1 including collecting excess slurry drained from the faceplate in the slurry dispensation operation and feeding it directly back for redispensation without the addition of a make-up slurry which is substantially different in phosphor content, viscosity or particle size distribution from that of the dispensed slurry.

7. The process defined by claim 1 wherein the slurry employed is super dense, having a phosphor content of 36% to 45% (by weight) and a viscosity of 40 to 60 centipoise.

8. A non-settling process for forming on an inner viewing surface of a color cathode ray tube faceplate a coating of an aqueous slurry composed of a photosensitized organic binder and a suspension of phosphor particles, which coating exhibits a high degree of coating weight uniformity, a relatively high phosphor coating weight, and suppressed radial streaking, said process comprising:

supporting the faceplate such that the central axis of the faceplate has a substantial horizontal component;

slowly rotating the faceplate about the central axis thereof while dispensing a stream of phosphor slurry onto the central region of the faceplate inner surface such that, due to gravitational forces and the slow rotation of the faceplate through the descending slurry stream, the slurry is suffused to the perimeter of the faceplate inner surface without any significant settling out of phosphor particles onto the faceplate;

slowly rotating the faceplate for a predetermined delay interval effective to permit any tangential "sags" formed the dispensed coating during the dispensation and suffusion operation to even out; and levigating the coating by rotating the coated faceplate at a moderate angular velocity for a brief time interval, the joint effect of which moderate velocity and interval being to level and thin down the coating to a predetermined thickness while suppressing the formation of radial streaks in the coating radially outwardly of irregularities in or on the faceplate inner surface.

9. The method defined by claim 8 wherein said delay interval is between about 3-15 seconds and wherein the speed of rotation of the faceplate during the delay interval is between about 5 and 30 RPM.

10. The method defined by claim 9 wherein said speed of faceplate rotation during said delay interval is the same as that employed during the dispensation and suffusion operation.

11. The method defined by claim 8 wherein during said levigating operation the faceplate is spun at an angular velocity of 100–200 revolutions per minute for a time interval which is between about 3–10 seconds.

12. The process defined by claim 8 including collecting excess slurry drained from the faceplate in the slurry dispensation operation and feeding it directly back for redispensation without the addition of a make-up slurry which is substantially different in phosphor content or particle size distribution from that of the dispensed slurry.

13. A non-settling process for forming on an inner viewing surface of a color cathode ray tube faceplate a coating of a super dense aqueous slurry composed of a photosensitized organic binder and a suspension of phosphor particles, which coating exhibits a high degree of coating weight uniformity and a relatively high phosphor coating weight, said process comprising:

supporting the faceplate such that the central axis of the faceplate has a substantial horizontal component;

slowly rotating the faceplate about the central axis thereof while dispensing onto the central region of the faceplate inner surface a stream of phosphor slurry having 36% to 45% (by weight) of phosphor material and a viscosity of 40 to 60 centipoise such that, due to gravitational forces and the slow rotation of the faceplate through the descending slurry stream, the slurry is suffused to the perimeter of the faceplate inner surface without any significant settling out of phosphor particles onto the faceplate; and levigating the coating by rotating the coated faceplate at a predetermined angular velocity for a predetermined time interval to level and thin down the coating to a predetermined thickness, the super density of the phosphor slurry increasing the phosphor coating weight in the resultant slurry coating.

14. A non-settling process for forming on an inner viewing surface of a color cathode ray tube faceplate a coating of an aqueous slurry composed of a photosensitized organic binder and a suspension of phosphor particles, which coating exhibits a high degree of coating weight uniformity and a relatively high phosphor coating weight, said process comprising:

supporting the faceplate such that the central axis of the faceplate has a substantial horizontal component;

slowly rotating the faceplate about the central axis thereof while dispensing a stream of phosphor slurry onto the central region of the faceplate inner surface such that, due to gravitational force and the slow rotation of the faceplate through the descending slurry stream, the slurry is suffused to the perimeter of the faceplate inner surface without any significant settling out of phosphor particles onto the faceplate;

levigating the coating by rotating the coated faceplate at a predetermined angular velocity for a predetermined time interval to level and thin down the coating to a predetermined thickness; and collecting the excess slurry drained from the faceplate during the slurry dispensation operation and feeding it directly back for redispensation without the addition of a make-up slurry differing substantially from the dispensed slurry in phosphor content, viscosity, phosphor-to-binder ratio or particle size distribution.

15. A non-settling process for forming on an inner viewing surface of a color cathode ray tube faceplate a coating of a super dense aqueous slurry composed of a photosensitized organic binder and a suspension of phosphor particles, which coating exhibits a high degree of coating weight uniformity, a relatively high phosphor coating weight, and suppressed radial streaking, said process comprising:

supporting the faceplate such that the central axis of the faceplate has a substantial horizontal component;

slowly rotating the faceplate about the central axis thereof while dispensing onto the central region of the faceplate inner surface a stream of phosphor slurry having 36%–45% (by weight) of phosphor material and a viscosity of 40–60 centipoise such that, due to gravitational forces and the slow rotation of the faceplate through the descending slurry stream, the slurry is suffused to the perimeter of the faceplate inner surface without any significant settling out of phosphor particles onto the faceplate;

slowly rotating the faceplate for a predetermined delay interval effective to permit any tangential "sags" formed in the dispensed coating during the dispensation and suffusion operation to even out;

levigating the coating by rotating the coated faceplate at a moderate angular velocity for a brief time interval, the joint effect of which moderate velocity and interval being to level and thin down the coating to a predetermined thickness while suppressing the formation of radial streaks in the coating radially outwardly of irregularities in or on the faceplate inner surface; and collecting the excess slurry drained from the faceplate during the slurry dispensation operation and feeding it directly back for redispensation without the addition of a make-up slurry differing substantially from the dispensed slurry in phosphor content, viscosity, phosphor-to-binder ratio or particle size distribution.

16. The method defined by claim 15 wherein during said levigation operation the faceplate is spun at an angular velocity of 100–200 revolutions per minute for a time interval which is between about 3–10 seconds.

17. The method defined by claim 16 wherein the angle of the faceplate axis to the vertical on the concave side of the faceplate is slightly greater than 90°.

18. The method defined by claim 17 wherein the angular velocity of said faceplate during the slurry dispensation and suffusion operation is between about 5 and 30 revolutions per minute and the dispense interval is between about 10–20 seconds.

19. The method defined by claim 18 wherein the slurry employed is super dense, having a phosphor content of 36% to 45% (by weight) and a viscosity of 40 to 60 centipoise.

20. The method defined by claim 19 wherein said delay interval is between about 3–15 seconds and wherein the speed of rotation of the faceplate during the delay interval is the same as that employed during the dispensation and suffusion operation.

* * * * *